US005562147A

United States Patent [19]

Bortoloni

[11] Patent Number: 5,562,147

[45] Date of Patent: Oct. 8, 1996

[54] MULTI-STAGE CASTING PLANT AND METHOD OF FORMING CASTINGS

[76] Inventor: Andrea Bortoloni, 191 Via Noventana, Noventa Padovana, Italy, 35027

[21] Appl. No.: 309,987

[22] Filed: Sep. 20, 1994

[30] Foreign Application Priority Data

Sep. 5, 1994 [IT] Italy ..... PD94A0154

[51] Int. Cl.[6] ..... B22D 18/02; B22D 18/04

[52] U.S. Cl. ..... 164/119; 164/120; 164/306

[58] Field of Search ..... 164/119, 120, 164/306, 309, 320

[56] References Cited

U.S. PATENT DOCUMENTS

| | | | |
|---|---|---|---|
| 969,539 | 9/1910 | Kitchen | 164/120 X |
| 3,523,570 | 8/1970 | Groteke et al. | 164/119 |
| 3,530,927 | 9/1970 | Lejeune | 164/120 |

FOREIGN PATENT DOCUMENTS

| | | | |
|---|---|---|---|
| 54-30645 | 10/1979 | Japan | 164/306 |
| 2-229660 | 9/1990 | Japan | 164/120 |
| 4-270056 | 9/1992 | Japan | 164/119 |
| 5-69105 | 3/1993 | Japan | 164/119 |
| 676381 | 7/1979 | U.S.S.R. | 164/306 |

*Primary Examiner*—J. Reed Batten, Jr.
*Attorney, Agent, or Firm*—Dowell & Dowell

[57] ABSTRACT

The movable upper portion of a mould is positioned in a first position. Molten metal is forced upwardly into the mould cavity through an opening in a stationary lower mould portion. The upper portion is lowered to a position below the first position to force molten metal into all regions of the mould cavity and to force excess metal back into the furnace. A stop is moved downwardly through an upper opening defined in the upper mould portion to close the lower opening. The upper portion is lowered to a second position, and an external downward force is applied on the upper portion to compress the metal within the mould. The method is particularly suitable for forming vehicle wheel rim castings with reduced subsequent surface processing.

14 Claims, 2 Drawing Sheets

MULTI-STAGE CASTING PLANT AND METHOD OF FORMING CASTINGS

BACKGROUND OF THE INVENTION

1. Field of the Invention

This invention concerns the sector of equipment for moulding objects by means of molten metal castings. It specifically concerns the production of metal objects by feeding molten metal under pressure from a holding furnace to a mould placed on a press plate located above the furnace.

2. Description of the Related Art

At present many metal objects, such as vehicle wheel rims, are produced by the forced injection of molten metal into a mould.

The usual procedure is to keep the molten metal in holding furnaces; above the holding furnace there is a hydraulic press, on the bottom plate of which is placed the mould communicating with the bottom of the holding furnace by means of a vertical pipe; when the furnace is put under pressure, for example using compressed air, the molten metal goes up the pipe to the mould and fills it. The pressure exerted in the furnace is maintained until the casting inside the mould begins to solidify.

The pressure is then decreased to allow the metal inside the pipe to flow back into the furnace. This method for producing metal objects by injection casting is preferred to other methods because of the better product quality obtained and the speed of execution, even though the parts thus obtained have to be subjected to further surface processing. It is therefore necessary to produce objects with higher thicknesses (machining allowance); the objects may have internal imperfections that cannot be detected by the naked eye.

SUMMARY OF THE INVENTION

To solve these problems, new equipment was studied so as to produce objects of superior quality. This study was carried out with the injection of metal to form a casting, with specific reference to vehicle wheel rims.

The process consists of the use of a mould with at least one mobile part. When the casting is injected the top part of the mould is kept in a higher position than its final one, while keeping the mould closed so that the internal mould volume is larger than the volume of the object to be produced.

The fluid metal is then injected into the mould; immediately after injection of the metal, keeping the furnace under pressure, the top part is pushed into the final position of the item to be produced. In this way the fluid mass of metal is forced into every part of the mould while the excess is pushed back into the furnace. When the mobile part has almost reached the final position for the item, a valve interrupts the communication of the metal flow between the mould and the furnace.

The mobile part continues its closing movement at high pressure.

The final closing of the mould at high pressure results in a series of positive features in the item produced.

The item solidifies faster, thus allowing an increase in the hourly production rate, the metal is of higher quality, free from micro-cracks, and the surface of the item is smoother, more homogeneous and requires less processing afterwards.

In the specific case of the production of vehicle wheel rims, the mould is composed of the two sides of the rim, a fixed bottom part and a mobile top part.

The part of the mould for the side of the rim is placed on the plate above the furnace; in the center, in a position corresponding to the wheel hub, is the entrance for the pipe communicating with the inside of the furnace.

The second part of the rim mould is mobile and is fitted onto a hydraulic piston.

This second part of the rim mould has a hole, co-axial with the pipe communicating with the furnace; in this hole is a rod driven by a second hydraulic piston;the rod has the same position and dimensions as the central hole in the rim into which the hub fits.

There is a cylinder around this rod, on the outside of the mould, driven by a third hydraulic piston. The production of a vehicle wheel rim goes through the following stages:

The furnace is loaded with fluid metal and the bottom part of the mould, forming one of the sides of the rim, is placed on the press.

The other part of the mould, forming the second side of the rim, is lowered until it meets the vertical walls of the parts of the mould forming the arc of the rim.

The furnace is put under pressure so as to make the molten liquid rise into the mould and fill it; the air in the mould comes out through holes provided for this purpose.

While keeping the furnace under pressure, the top part of the mould is lowered so as to force the molten metal into all parts of the mould, distribute the metal homogeneously and force the excess metal back into the furnace.

When the top part of the mould has almost reached its final position, the central rod is lowered so as to close the pipe communicating with the furnace; the top part of the mould continues to come down until it reaches its final position, further compressing the mass of metal which passes from a fluid state to a plastic state as a result of the strong pressure.

Finally the external cylinder of the rod is lowered, further compressing the top part of the mould for the final crushing movement; in this way the metal inside the mould solidifies rapidly as a result of the huge pressure and its consistency is made uniform, reducing to a minimum the amount of air or gas that it may contain, which have formed as a result of the contact between the hightemperature metal and the mould at a lower temperature, preventing the formation of micro-cracks that go right through.

Finally all the parts of the mould are opened and the item produced is sent on for final finishing.

immediately after the brief description of the drawings insert the following heading:

DETAILED DESCRIPTION OF THE INVENTION

A practical execution of the procedure is described below, with reference to the drawings enclosed as an example, without limitation.

Figure 1:
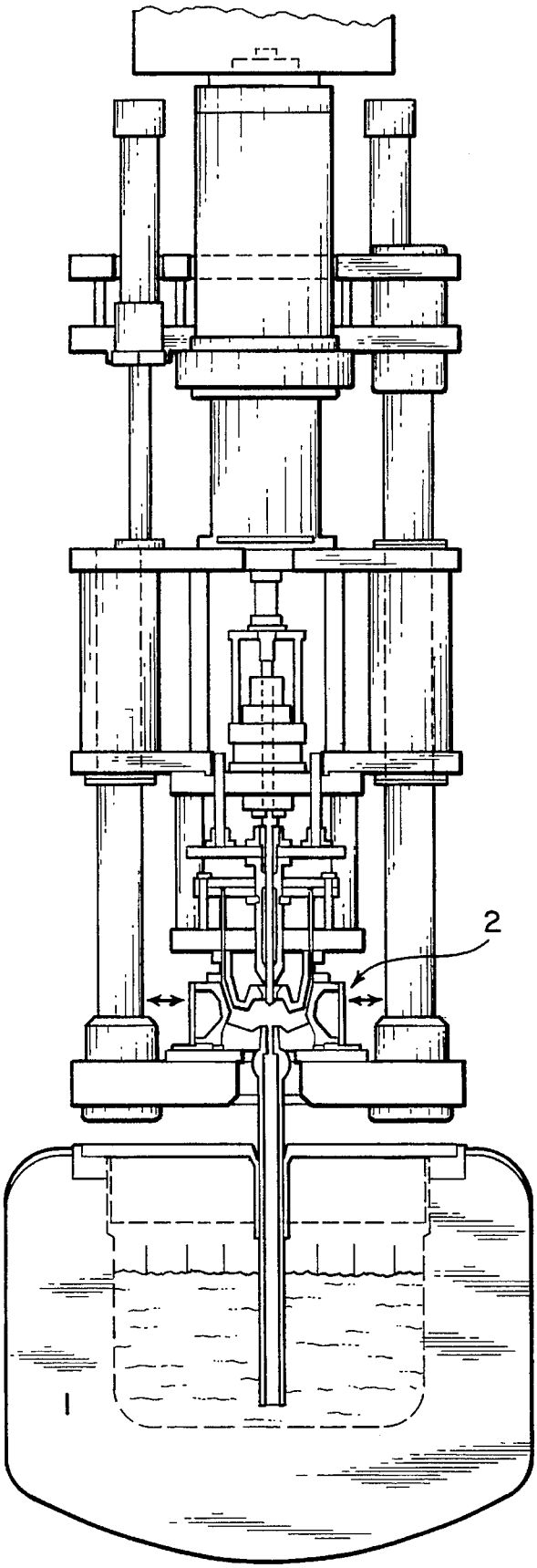
FIG. 1 is an elevational view illustrating a furnace, a mould and structure for moving portions of the mould in accordance with the invention.

FIG. 1 shows a vertical section of the furnace (1), the mould (2) and part of the structure for moving the various parts of the mould.

Figure 2:
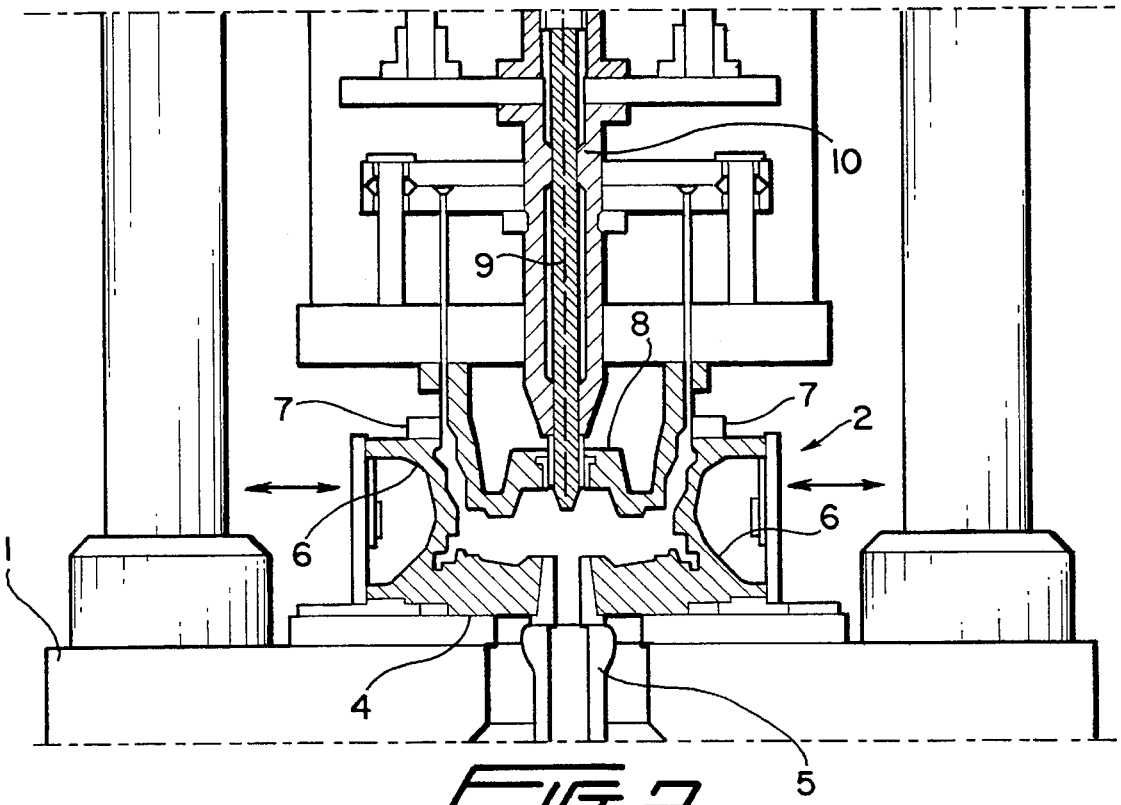
FIG. 2 is an enlarged partial cross-sectional view illustrating the two mould portions, a vertically movable rod and a surrounding mobile cylinder in a first position.
Figure 3:
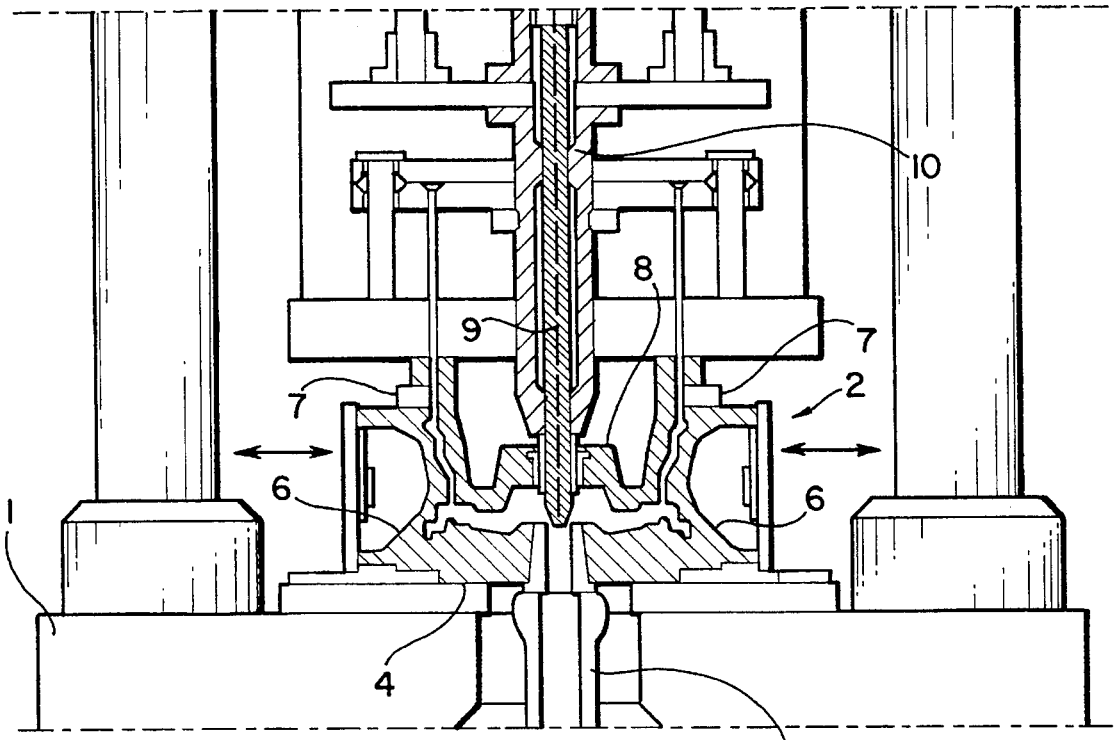
FIG. 3 illustrates the movable mould portion, the vertical rod and the mobile cylinder of FIG. 2 in a second lower position.

FIGS. 2 and 3 show in section two stages during the production of a wheel rim. In both figures only the main parts of the mould are shown.

In FIG. 2 the bottom part of the mould (4), forming one of the sides of the rim, is placed above the furnace (1) and communicates with it by means of the central pipe (5).

On the sides of the bottom part of the mould (4) are placed the arc elements (6) that form the circumference of the rim; at the top of these elements there are vertical walls (7) that correspond with the position of the top part of the mould (8).

In the center of the top part of the mould (8) there is a mobile vertical rod (9); this rod being aligned with the pipe (5) communicating with the furnace (1).

Around the vertical rod (9), above the top part of the mould (8), is the mobile cylinder (10).

In operation, the mould (2) is closed with its top part (8) raised above its final position; the fluid metal is injected through the communicating pipe (5) until it fills the mould; the top part of the mould (8) is then lowered and, when it has almost reached its final position, the vertical rod (9) is lowered until the communicating pipe (5) is closed as illustrated in FIG. 3.

When the top part of the mould (8) has reached its final position the mobile cylinder (10) is lowered so as to increase the pressure on the metal which is now solidifying.

In this way the metal solidifies faster and after a short time it is possible to open all the parts of the mould, thus obtaining a rim with all the best characteristics described above.

These schematic indications are sufficient to allow a skilled operator to perform the procedure; when putting them into practice, variations may be made without in any way affecting the substance of this innovative concept.

Consequently, with reference to the description given above and to the drawings enclosed, the following claims are made.

I claim:

1. A method of forming metal castings, comprising the steps of:

providing a source of molten metal;

providing a mould above said source of molten metal, said mould comprising a stationary lower portion defining a lower opening and a movable upper portion defining an upper opening coaxial with said lower opening, said mould defining an internal cavity, and the upper portion being vertically movable relative to the lower portion between a first position and a lower second position;

positioning the upper portion in said first position;

pressurizing said source of molten metal to force molten metal into said internal cavity via said lower opening;

lowering the upper portion to a position between said first and second positions to force the molten metal into all portions of said internal cavity and to force excess molten metal into said source of molten metal;

moving a stop downwardly through said upper opening to close said lower opening;

lowering the upper portion to said second position; and applying external downward force on the upper portion to further compress the metal within said internal cavity.

2. The method of claim 1, wherein said internal cavity has the shape of a vehicle wheel rim.

3. The method of claim 2, wherein the lower portion of said mould comprises vertical walls defining an arc of the vehicle wheel rim, and the step of positioning comprises lowering the upper portion of the mould until the upper portion contacts said vertical walls.

4. An apparatus for forming metal castings, comprising:

a mould comprising a stationary lower portion defining a lower opening and a movable upper portion defining an upper opening coaxial with said lower opening, said mould defining an internal cavity;

means for supplying molten metal into said mould via said lower opening;

means for moving the upper portion vertically relative to the lower portion between a first position and a lower second position;

stop means for lowering through said upper opening to close said lower opening when the upper portion is positioned between said first and second positions; and means for applying external downward pressure on the upper portion in said second position to further compress the metal within said internal cavity.

5. The apparatus of claim 4, wherein the means for supplying molten metal into said mould comprises a furnace containing a supply of molten metal and a conduit, said furnace being disposed below said mould and said conduit having an end positioned in said molten metal and extending upwardly from said furnace into the lower portion of said mould.

6. The apparatus of claim 4, wherein the means for moving the upper portion comprises a first hydraulic mechanism.

7. The apparatus of claim 4, wherein the stop means comprises a vertically adjustable cylindrical rod.

8. The apparatus of claim 7, further comprising a second hydraulic mechanism for moving said rod.

9. The apparatus of claim 4, wherein the means for applying external downward pressure on the upper portion of said mould comprises a cylinder surrounding, and being vertically movable relative to, said stop means.

10. The apparatus of claim 9, wherein said cylinder exerts pressure on an outer surface of the upper portion of said mould adjacent to said upper opening.

11. The apparatus of claim 10, further comprising a third hydraulic mechanism for moving said cylinder in a vertical direction.

12. The apparatus of claim 4, wherein said upper opening and said lower opening are centrally located in the upper portion and the lower portion, respectively, of said mould.

13. The apparatus of claim 4, wherein said mould defines an internal cavity having the shape of a vehicle wheel rim.

14. An apparatus for forming metal vehicle wheel rims, comprising:

a mould comprising a stationary lower portion defining a lower opening and a movable upper portion defining an upper opening coaxial with said lower opening, said upper opening and said lower opening being centrally located in the upper portion and the lower portion, respectively, said mould defining an internal cavity having the shape of a vehicle wheel rim, and the lower portion having vertical walls defining an arc of the vehicle wheel rim;

a furnace containing a supply of molten metal and a conduit, said furnace being disposed below said mould, said conduit having an end positioned in said molten metal and extending upwardly from said furnace into the lower portion of said mould;

first hydraulic means for moving the upper portion vertically relative to the lower portion between a first position, in which the upper portion contacts said vertical walls of the lower portion, and a lower second position;

a vertically adjustable rod extending through said upper opening for closing said lower opening when the upper portion is positioned between said first and second positions;

second hydraulic means for vertically moving said rod;

a cylinder surrounding the rod for directly contacting and applying external downward pressure on the upper portion in said second position to further compress the metal within said internal cavity; and third hydraulic means for vertically moving said cylinder.

* * * * *